United States Patent [19]

Dickerson

[11] 4,083,515

[45] Apr. 11, 1978

[54] METHOD AND APPARATUS FOR DETERMINING AND CONTROLLING WIRE SPACING ON A SPOOL

[75] Inventor: Henry A. Dickerson, Bristol, Va.

[73] Assignee: Westinghouse Electric Corporation, Pittsburgh, Pa.

[21] Appl. No.: 634,001

[22] Filed: Nov. 20, 1975

[51] Int. Cl.[2] ..... B65H 54/30

[52] U.S. Cl. ..... 242/158 R; 242/158.2; 340/259

[58] Field of Search ..... 242/158 R, 158.2, 158.4; 340/259, 260

[56] References Cited

U.S. PATENT DOCUMENTS 3,031,153 4/1962 Attwood et al. ..... 242/158 R 3,829,037 8/1974 Sallin ..... 242/158 R

FOREIGN PATENT DOCUMENTS 38-18221 9/1963 Japan ..... 242/158.2

899,531 6/1962 United Kingdom ..... 242/158 R

*Primary Examiner*—George F. Mautz

*Attorney, Agent, or Firm*—R. D. Fuerle

[57] ABSTRACT

The distance between turns of wire being wound on a spool is determined and controlled by generating a signal proportional to the traverse speed, generating a signal proportional to the spool speed, dividing one by the other, and displaying the output signal in units traversed per spool revolution. The traverse speed is then adjusted until the traverse rate is slightly greater than the wire width.

11 Claims, 1 Drawing Figure

METHOD AND APPARATUS FOR DETERMINING AND CONTROLLING WIRE SPACING ON A SPOOL

BACKGROUND OF THE INVENTION

Figure 1:
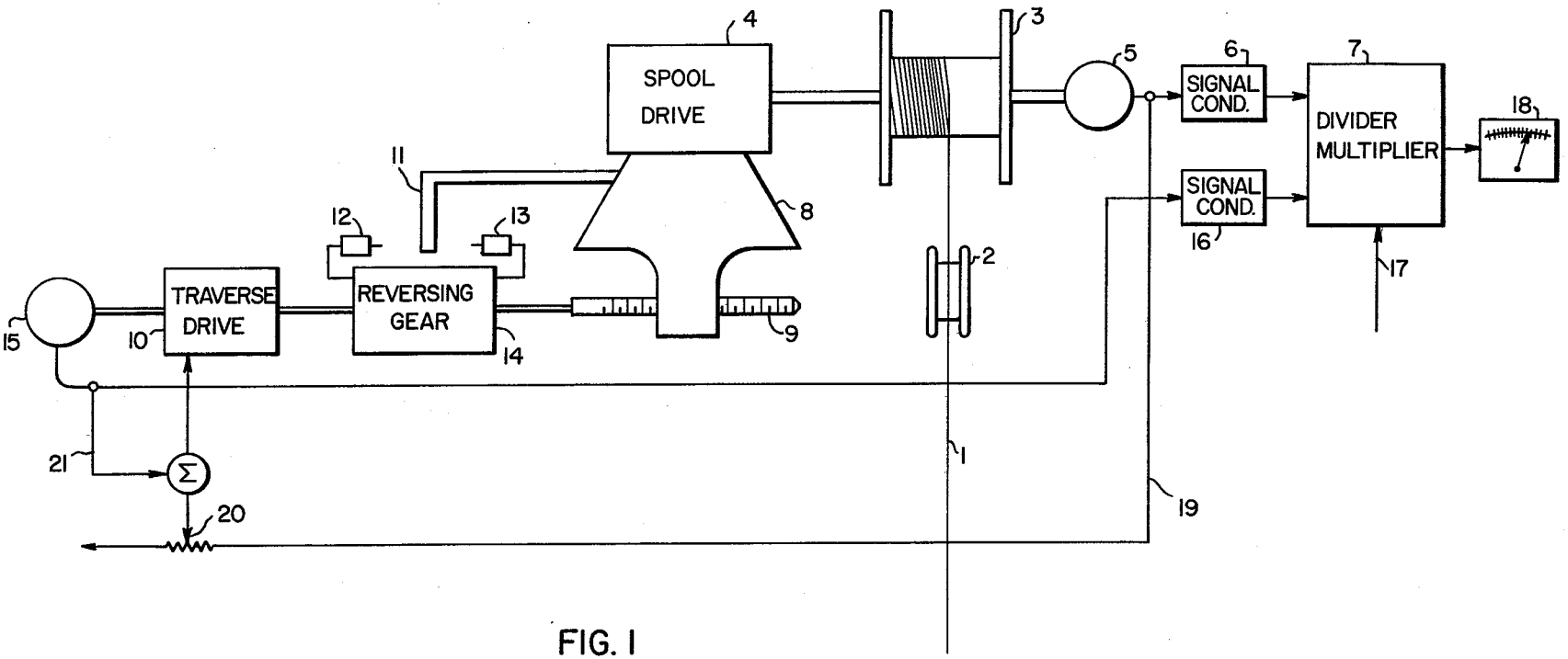

After wire is made it is wound onto spools for storage or sale. Rectangular wire in particular must be precisely spaced on the spool in order to avoid overlapping turns or large gaps between turns, either of which can abraid and damage the wire as it slips against adjacent turns or twists into gaps between turns.

Presently, the traverse speed is adjusted visually as the wire is being wound. A good operator can "fine tune" the traverse speed to achieve a neatly-laid coil, but a poor operator is likely to produce a coil so disheveled that it must be rewound or, if damaged, scrapped. When a changeover is made to wire of a different width, a certain amount of experimenting is necessary to again find the correct traverse speed setting.

PRIOR ART

U.S. Pat. Nos. 3,031,153 and 3,133,236 disclose devices for controlling the traverse rate on a wire winding apparatus.

U.S. Pat. Nos. 2,860,241 and 3,202,809 disclose circuits for dividing electrical signals.

SUMMARY OF THE INVENTION

I have discovered a method and apparatus for determining and controlling the distance between adjacent turns of wire wound onto a spool. Signals proportional to the spool speed and the traverse speed are generated, one is divided by the other, and the result used to indicate the traverse rate in some appropriate units of traverse movement per spool revolution.

Unlike the previous commercial method of adjusting the traverse speed by visual examination of the wire as it is wound, in my invention the winding apparatus is first operated without wire and the traverse speed is simply set to the width of wire to be wound.

DESCRIPTION OF THE INVENTION

The accompanying drawing is a schematic view of a presently-preferred embodiment of an apparatus according to this invention for controlling the spacing between turns of wire as it is wound onto a spool.

In the drawing wire 1 passes over guide 2 as it is wound onto spool 3. The spool is driven by spool drive 4, the speed of which is adjustable. The spool drive also turns tachometer generator 5 which generates an electrical signal, the voltage of which is proportional to the speed at which the spool rotates. This electrical signal goes to signal conditioner 6, which smooths out minor fluctuations and either attenuates or amplifies the signal to provide a suitable denominator input to divider-multiplier 7. The signal conditioner 6 can also include a rectifier to convert from AC to DC if an AC tachometer generator is used.

Spool drive 4 is mounted on support 8 and is moved laterally by lead screw 9 which is driven by traverse drive 10. When arm 11, attached to support 8, contacts limit detector 12 or 13, reversing gear 14 changes the direction that lead screw 9 rotates. The position of the limit detectors may be set according to the width of the spool being wound. Traverse drive 10 also turns a second tachometer generator 15, which generates an electrical signal, the voltage of which is proportional to the speed at which the traverse drive rotates and therefore to the speed at which spool drive 4 traverses. This electrical signal goes to signal conditioner 16, similar to signal conditioner 6, then to the numerator input of divider-multiplier 7. The divider-multiplier preferably divides the voltage of the signal from generator 15 by the voltage of the signal from generator 5 (the reciprocal could also be used) and multiplies the dividend by an adjustable calibrating constant, shown as an adjustable voltage from control device 17. The divider-multiplier may be two separate units if desired. This product is then displayed on traverse rate indicator 18. Since the traverse speed must increase and decrease with the spool speed, the traverse speed is controlled by the spool speed through a signal from generator 5 through line 19 to control 20. The control 20 can be adjusted to control the ratio of traverse speed to spool speed. The signal from generator 15 is summed with the signal from control 20 through line 21 to produce a speed error signal to traverse drive 10 as is required to achieve a traverse drive speed that is an accurate portion of the spool speed.

Since divider-multiplier 7 divides a voltage which is proportional to the traverse speed by a voltage which is proportional to the spool speed and multiplies the product by a calibrating constant, indicator 18 can be adjusted through the calibrating constant to read in inches traversed per spool revolution.

To operate the apparatus, the spool and traverse drive are energized with no wire being wound. The traverse drive speed is then manually adjusted until traverse rate indicator 18 shows that the inches (or other units) traversed per spool revolution is a few thousandths of an inch greater than the width of the wire to be wound. The traverse limit detectors are set so that the distance traversed by the spool corresponds to the inside width of the particular spool being used. The wire is then connected to the spool and is wound.

Several variations on the apparatus shown in the drawing are also contemplated within the scope of the invention. The drawings show the spool traversing and that arrangement is preferred because the wire is always laid normal to the spool axis. However, the guide may be made to traverse instead if so desired. The signals which are proportional to the traverse and spool speeds could be currents instead of voltages, although voltages are preferred as less expensive apparatus is required. Digital signals could also be used, the division being made with a small computer and the dividend converted to an analog signal to drive the traverse rate indicator 18, which could be a digital display.

I claim:

1. In an apparatus for winding a wire onto a spool, said apparatus having means for controlling the speed at which said wire traverses relative to said spool speed, a method of setting and thereafter maintaining as set the distance traversed per spool revolution regardless of changes in spool speed, comprising:

1. generating a first signal proportional to said traverse speed;
2. generating a second signal proportional to the speed that said spool rotates;
3. dividing one signal by the other to produce an output signal;
4. displaying said output signal in units of distance traversed per spool revolution;

5. adjusting said traverse speed until the desired distance traversed per spool revolution is displayed; and 6. maintaining the ratio of traverse speed to spool speed.

2. A method according to claim 1 wherein said spool traverses and said wire is fixed.

3. A method according to claim 1 wherein said apparatus is first operated without wire and said traverse speed is set according to said display so that the distance traversed per spool revolution is slightly greater than the width of the wire to be wound.

4. A method according to claim 1 wherein said first and second signals are voltages.

5. A method according to claim 1 wherein said wire is rectangular.

6. A method according to claim 1 wherein said first signal is divided by said second signal.

7. In an apparatus for winding a wire onto a spool, said apparatus having means for controlling the speed at which said wire traverses relative to said spool speed, apparatus for setting the distance traversed per spool revolution comprising:

1. means for generating a first signal proportional to said traverse speed;

2. means for generating a second signal proportional to the speed that said spool rotates;

3. means for dividing one signal by the other signal to produce an output signal;

4. means for displaying said output signal in units traversed per spool revolution; and 5. means for maintaining the ratio of traverse speed to spool speed.

8. An apparatus according to claim 7 wherein said spool traverses and said wire is fixed.

9. An apparatus according to claim 7 wherein said first and second signals are voltages.

10. An apparatus according to claim 7 wherein said wire is rectangular.

11. An apparatus according to claim 7 wherein said first signal is divided by said second signal.

* * * * *